US009222221B2

(12) United States Patent
Caspar

(10) Patent No.: US 9,222,221 B2
(45) **Date of Patent: *Dec. 29, 2015**

(54) CLEANING APPARATUS

(71) Applicant: Paprima industries Inc., Quebec (CA)

(72) Inventor: Roman Caspar, Riehen (CH)

(73) Assignee: PAPRIMA INDUSTRIES INC., Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/330,379

(22) Filed: Jul. 14, 2014

(65) Prior Publication Data

US 2014/0374046 A1 Dec. 25, 2014

Related U.S. Application Data

(63) Continuation of application No. 13/517,946, filed as application No. PCT/IB2010/003519 on Dec. 21, 2010, now Pat. No. 8,808,504.

(30) Foreign Application Priority Data

Dec. 21, 2009 (DE) ..... 10 2009 597 905

(51) Int. Cl.
*D21F 1/32* (2006.01)
*B08B 3/02* (2006.01)

(52) U.S. Cl.
CPC . *D21F 1/32* (2013.01); *B08B 3/022* (2013.01); *B08B 2203/0229* (2013.01)

(58) Field of Classification Search
USPC ..... 162/199, 272; 134/170
See application file for complete search history.

(56) References Cited

U.S. PATENT DOCUMENTS 1,550,304 A 8/1925 Dolan
5,381,580 A 1/1995 Kotitschke et al.

(Continued)

FOREIGN PATENT DOCUMENTS

DE 29517859 U1 1/1996
DE 69314805 2/1998

(Continued)

OTHER PUBLICATIONS

Office Action dated Jun. 13, 2014 of China application 201080058269.5 with related claims 1-21.

(Continued)

*Primary Examiner* — Mark Halpern
(74) *Attorney, Agent, or Firm* — J-Tek Law PLLC; Jeffrey D. Tekanic; Scott T. Wakeman

(57) ABSTRACT

A cleaning apparatus includes at least one cleaning nozzle that generates and directs a high-pressure liquid jet towards a point of impact on a surface, such as a conveyor belt having a drying screen. A cleaning head has a main opening that faces towards the surface, a discharge opening and a wall with at least one inlet opening defined therein. The at least one cleaning nozzle is disposed outside of the cleaning head and is oriented such that the high-pressure liquid jet passes through the at least one inlet opening before striking the surface. At least one first compressed air supplying device is disposed outside of the cleaning head and is configured to steer liquid from the at least one cleaning nozzle, after it has struck the surface, towards the main opening of the cleaning head.

26 Claims, 7 Drawing Sheets

(56) References Cited

U.S. PATENT DOCUMENTS

| | | | | |
|---|---|---|---|---|
| 5,603,775 | A | 2/1997 | Sjoberg | |
| 5,783,044 | A | 7/1998 | Schneider et al. | |
| 5,879,515 | A | 3/1999 | Straub et al. | |
| 5,964,956 | A | 10/1999 | Straub et al. | |
| 5,964,960 | A | 10/1999 | Boeck | |
| 6,001,219 | A | 12/1999 | Caspar | |
| 6,021,699 | A | 2/2000 | Caspar | |
| 6,022,452 | A | 2/2000 | Caspar | |
| 6,050,392 | A | 4/2000 | Straub | |
| 6,051,076 | A | 4/2000 | Oechsle et al. | |
| 6,073,825 | A | 6/2000 | Hilker | |
| 6,135,000 | A | 10/2000 | Caspar et al. | |
| 6,360,758 | B1 | 3/2002 | Eivola et al. | |
| 6,364,959 | B1 | 4/2002 | Straub et al. | |
| 6,457,335 | B1 | 10/2002 | Fleissner | |
| 6,516,819 | B1 | 2/2003 | Pearson | |
| 6,681,670 | B2 | 1/2004 | Caspar et al. | |
| 8,808,504 | B2 * | 8/2014 | Caspar | 162/199 |
| 2002/0124702 | A1 | 9/2002 | Caspar et al. | |
| 2003/0209613 | A1 | 11/2003 | Miyauchi et al. | |
| 2011/0083795 | A1 | 4/2011 | Kowalewski et al. | |
| 2012/0006357 | A1 | 1/2012 | Caspar | |

FOREIGN PATENT DOCUMENTS

| | | | |
|---|---|---|---|
| DE | 60012180 | | 8/2005 |
| DE | 102007028341 | A1 | 12/2008 |
| EP | 0870583 | B1 | 7/2002 |
| EP | 1085121 | B1 | 7/2004 |
| EP | 1753909 | B1 | 10/2009 |
| FR | 2826597 | A | 1/2003 |
| JP | 1246488 | | 10/1989 |
| JP | 4-370287 | A | 12/1992 |
| WO | 9412349 | A | 6/1994 |
| WO | 2005113890 | A1 | 12/2005 |

OTHER PUBLICATIONS

Amendment and Arguments Accompanying PCT Chapter II Demand dated Oct. 21, 2011 from parent PCT application No. PCT/IB2010/003419, including amended claim set.

Amendments and Arguments Further to PCT Chapter II Demand dated Jan. 24, 2012 from parent PCT application No. PCT/IB2010/003419, including amended claim set.

EP application 10838785 search report and search opinion with related claims 1-15 and google translation of the same.

International Preliminary Report on Patentability dated Apr. 4, 2012 from parent PCT application No. PCT/IB2010/003419, including Art. 34 PCT claims examined by IPEA/CA.

International Search Report dated Jun. 23, 2011 from parent PCT application No. PCT/IB2010/003419.

Office Action dated Aug. 6, 2010 for priority DE application No. 10 2009 059 790.5-27, including translation of prior art rejections.

Office Action dated Feb. 27, 2013 for priority DE application No. 10 2009 059 790.5-27, including translation of prior art rejections.

Translation of parent PCT application No. PCT/IB2010/003419 submitted to ISA during the International phase.

Written Opinion dated Jun. 27, 2011 from parent PCT application No. PCT/IB2010/003519.

* cited by examiner

CLEANING APPARATUS

CROSS-REFERENCE

This application is a continuation of U.S. patent application Ser. No. 13/517,946, filed Sep. 4, 2012, the entire contents of which are hereby incorporated by reference. U.S. Ser. No. 13/517,946 is the U.S. national stage of International Application No. PCT/IB2010/003519 filed On Dec. 21, 2010, which claims priority to German patent application no. 10 2009 059 790.5 filed on Dec. 21, 2009.

TECHNICAL FIELD

The invention relates to an apparatus and a method for cleaning the conveyor belt of a drying screen of a paper production system.

RELATED ART

Due to always faster running speeds of paper production systems, more powerful cleaning apparatuses are always required for cleaning the drying screen. These apparatuses should not malfunction, effect highly efficient cleaning, save resources (water, energy, conveyor belt material), not only remove dirt particles from the belt but also transport them away in a controlled manner and, in addition, dry the drying screen as rapidly as possible after the cleaning operation.

In practice, various solutions are offered for this purpose.

DE 295 17 859 U1 describes a cleaning system that cleans a conveyor belt by means of air jets or liquid jets, which are generated by stationary nozzles, wherein a dirt mist and/or water mist or residual water can be suctioned by a cleaning head (referred to therein as a "suction bell") by means of a negative pressure generated therein, and can be discharged. The jet nozzles are attached either within or beneath the suction chamber.

DE 693 14 805 T2 describes a cleaning apparatus that generates a liquid jet for cleaning the surface by means of at least one nozzle located in a cleaning head (referred to therein as a "suction nozzle") and applies it to the surface. In addition to the negative pressure generated in the cleaning head, compressed air is supplied to the main opening of the cleaning head, such that the compressed air impinges on processing liquid deflected from the surface and on material separated from the surface and, acting together with the suction effect of the cleaning head, entrains this processing liquid and material in the direction of the cleaning head.

It is disadvantageous to the solutions of the prior art that the nozzles, provided they are disposed within the cleaning head, risk becoming blocked by the suctioned dirt that is carried away from the cleaned surface. In addition, there is the risk that the cleaning head will be blocked by the dirt residues that have been detached and suctioned, especially when the angled nozzles, or even only parts of the nozzles, are located in the cleaning head. Provided that the nozzles are attached outside the cleaning head, it has been necessary to increase the distance of the cleaning-head opening to the surface to be cleaned, so that the jets will strike the surface to be cleaned. It has been necessary either to accept the greater amount of spray water or dirt produced or to compensate for this through increased application of suction energy.

SUMMARY

It is object of the present invention to provide an apparatus and a method for cleaning a conveyor belt of a drying screen of a paper production system that avoid or overcome one or more disadvantages of the prior art.

In particular, the object is achieved by a cleaning apparatus (20) for cleaning the conveyor belt (1) of a drying screen in a paper production system (2), comprising at least one cleaning nozzle (40) for generating a high-pressure jet (60) of a liquid having a point of impact (61) on the conveyor belt, at least one cleaning head (80) having a discharge opening (84) and a main opening (81) that faces towards the conveyor belt (1), wherein the cleaning nozzle (40) is disposed outside the cleaning head (80).

The conveyor belt is preferably the conveyor belt of a drying screen, or the drying screen per se, and is usually made of a porous, air-permeable material in which dirt and paper residues readily collect. The cleaning apparatus according to the invention is also suitable, however, for analogous applications in which a surface that is preferably in movement should be cleaned.

A cleaning nozzle, or also jet nozzle, according to the invention is a nozzle that is adapted to generate a jet of a fluid, preferably a jet of a liquid. Preferably, the nozzle is at least one diamond nozzle. Preferably, the cleaning nozzle is adapted to generate a high-pressure jet. Preferably, this pressure is in the range from 250 to 600 bar, particularly preferably in the range from 350 to 560 bar. Even more particularly preferably, the pressure is 450 bar. Preferably, this liquid is water. The diameter of the nozzle opening is preferably in the range from 0.1 mm to 0.3 mm. Particularly preferably, the diameter is approximately 0.15 mm. The cleaning nozzle preferably has a connection hose, which is adapted to supply the fluid that is used. A high-power pump is preferably connected to the other end of the connection hose. Particularly preferably, the supply hose is a Teflon hose. The jet direction—and consequently also the point at which a jet generated by the cleaning nozzle strikes the conveyor belt (the point of impact)—is adjustable. Preferably, the jet direction is adjustable using the holder of the cleaning nozzle.

The orientation of a cleaning nozzle according to the invention can preferably be adjusted over two angles. On the one hand, this is the angle W1, which is formed by the imaginary projection of a high-pressure jet, which is producible by the cleaning nozzle, and the moving direction of the conveyor belt (see, in connection therewith, 63 in FIG. 7). On the other hand, this is the angle W2, which is formed by the high-pressure jet, which is producible by the cleaning nozzle, and the surface of the conveyor belt (see, in connection therewith, 64 in FIG. 7). Preferably, the orientation of a cleaning nozzle according to the invention is variable, preferably electromechanically and/or hydraulically, preferably during the cleaning process.

The cleaning head is a component already known in a similar manner from the prior art. Cleaning heads that serve as a suction bell or suction chamber are described in DE 295 17 859 U1 and DE 693 14 805 T2. The cleaning head in this invention is not limited to operation as a suction chamber, as in the prior art. Through components described further below, an operation of the cleaning head is also provided in which dirt and spray water are transported away by positive pressure in the interior space of the cleaning head. Preferably, the cleaning head has a round cross-section, and encloses an interior space in which substances, such as the spray water that is produced during the cleaning operation and that entrains dirt with it, and/or dirty air and/or suspended matter, are catchable. Furthermore, the cleaning head preferably has a discharge opening, through which the substances that have been caught are transportable away from the interior space of the cleaning head, or can be exhausted. Preferably, the cleaning head is a tube-like component. A particularly preferred arrangement is that the central axis of the cleaning head is located 3-8 mm in front of the tangential line of the drying screen return roller ("dryer fabric return roll") or of any one of the drying screen rollers of the moving conveyor belt. Preferably, the cleaning head is disposed perpendicular to the surface of the conveyor belt. At the discharge opening—in the case of a tube, for example at the tube end that faces away from the conveyor belt—, the cleaning head preferably includes a connector piece, at which the cleaning head preferably is connectable to a discharge and/or negative pressure system. Preferably, the connector piece is a quick-connector system. With a quick-connector system, the cleaning head is quickly coupleable and/or decoupleable, and exchangeable. If it requires a repair or a thorough cleaning, it can be decoupled in a time-saving manner. Long downtimes of the cleaning apparatus, and therefore of the paper production system, are thereby avoided. Preferably, the cleaning head is joinable together, in telescoping manner, from a plurality of tube segments.

The opening of the cleaning head that faces towards the conveyor belt is the main opening. Preferably, the diameter of the cleaning head becomes larger towards the main opening. Preferably, the diameter of the main opening is in the range from 50 mm to 400 mm, particularly preferably the diameter is approximately 230 mm. The interior space between the main opening and the discharge opening preferably defines a discharge path for the substances that have been caught. The cleaning head preferably has bends and/or curvatures between the main opening and the discharge opening, such that the discharge opening is preferably located to the side of the conveyor belt. Preferably, the cleaning head has a sealing device at the sealing-head opening. Preferably, this sealing device is a rubber lip that matches the geometry of the opening. Preferably, the cleaning head has closable openings, or inspection openings, in its peripheral surface. Preferably, these closable openings are provided in the portion of the cleaning-head end that faces away from the conveyor belt—e.g. in the portion of the tube end that faces away from the conveyor belt—particularly preferably in the portion of bends and/or curvatures of the cleaning head. The closable openings are preferably designed in such a way that the inside of the cleaning head can be cleaned from the outside. The advantage is that, if a moderate blockage were to occur, the cleaning head is easily cleanable from the outside, for example by rinsing jets.

The apparatus according to the invention includes at least one cleaning nozzle, which is attached outside the cleaning head. This cleaning nozzle is preferably located outside an airflow that is present in the interior space of the cleaning head and that, during operation, carries with it a mixture of dirt and water. The cleaning nozzle is thus protected against contamination caused by the dirt and water of the airflow. Particularly preferably, a cleaning nozzle is disposed outside the cleaning head and outside the imaginary extension of the cleaning head between the main opening and the conveyor belt. Preferably, a cleaning nozzle attached outside the cleaning head is at a greater distance from the conveyor belt than is the main opening. Preferably, the cleaning head is rotatably, particularly preferably translationally, adjustable relative to at least one of these cleaning nozzles that is present. Preferably, the distance and/or the orientation of at least one cleaning nozzle is alterable relative to the cleaning head. Preferably, at least one cleaning nozzle attached outside the cleaning head has a minimum distance to the outer surface of the cleaning head that is greater than zero, preferably in the range from 0.1 mm to 500 mm, particularly preferably 1 mm to 250 mm, even more particularly preferably 2 mm to 90 mm, even more particularly preferably 3 mm to 80 mm, even more particularly preferably 5 mm to 70 mm, and even more particularly preferably 10 mm to 60 mm. Particularly preferably, the nozzle opening has this just mentioned minimum distance to the outer surface of the cleaning head. Preferably, the cleaning nozzle is disposed such that a fluid jet generated by the cleaning nozzle spans a preferably unobstructed path outside the cleaning head before it reaches the inside of the cleaning head. Preferably, the cleaning nozzle is not in direct contact with the cleaning head. Preferably, the cleaning nozzle is connected to the cleaning head, preferably solely via a mounting that preferably projects from the outer wall of the cleaning head.

Due to the described arrangement of the cleaning nozzle—including the nozzle retaining nut—outside of the cleaning head, the cleaning nozzle is not exposed to an airflow present in the interior space of the cleaning head. Due to the arrangement of cleaning nozzle, and in particular the nozzle opening, outside of the cleaning head, and not inside, the path of this airflow is not blocked. The servicing access to the cleaning nozzles that are provided is unimpeded. The nozzles also do not become blocked by the suspended matter and/or contaminants in the air, which draws along with it, in particular, an airflow present within the cleaning head. In addition, a cleaning head is thus usable in a simple design, without internally attached mountings, cavities or screwed-on bushings or the like for cleaning nozzles, on which the dirt collects. As a result, the cleaning head can also be cleaned more easily.

The cleaning head and the cleaning nozzles that are present—also, the respective further described components for further exemplary embodiment described below—are also usable in other cleaning apparatuses. During the cleaning operation, the cleaning head, together with the components attached thereto, is preferably at a distance of 5 mm to 20 mm from the conveyor belt. Particularly preferably, this distance is approximately 10 mm.

In a further exemplary embodiment of the present invention, the wall of the cleaning head (80) has at least one inlet opening (82), and at least one cleaning nozzle (40) is oriented such that a high-pressure jet (60) from the cleaning nozzle (40) strikes the conveyor belt (1) from the outside through one of the inlet openings (82) that is provided.

An inlet opening is, for example, a small hole, a bore, oblique bore, a slot extending preferably parallel to the cleaning-head axis that is perpendicular to the plane of the conveyor belt (for example: the tube central axis in case the cleaning head is preferably a tube-like component), a notch or other passage, which has at least the diameter of the high-pressure jet. The diameter of such an inlet opening falls within the range of, preferably, 0.1 mm to 200 mm, particularly preferably 0.125 mm to 100 mm, more particularly preferably 0.15 to 10 mm, even more particularly preferably 0.15 mm to 3 mm. At least one such inlet opening is located in the wall of the cleaning head. Through such an inlet opening, a high-pressure jet is guidable from the outside into the interior space of the cleaning head. The point of impact of the cleaning nozzle disposed outside the cleaning head is adjustable to a point on the conveyor belt so that it is located within the contour of the projection of the geometry of the main opening onto the conveyor belt. Without the inlet opening, such a point would be covered by the lateral wall of the cleaning head if the cleaning head having the main opening were to be attached directly adjacent to the conveyor belt. An inlet opening can also be covered, for example, by an adhesive tape, such that a cleaning jet then subsequently shoots a hole through the adhesive tape and, consequently, the inlet opening has a diameter that is precisely matched to the diameter of the cleaning jet.

In spite of the cleaning head being attached close to the conveyor belt, the inlet opening enables that at least one jet can strike the conveyor belt at a point preferably located in the airflow of the cleaning head, preferably within the inner contour of the main opening of the cleaning head on the conveyor belt that is projected onto the conveyor belt. Dirt and waste water can thus be caught, and preferably transported away, directly at the place of emanation, without a large gap being present between the main opening and the conveyor belt, through which gap, on the one hand, dirt can leak and, on the other hand, the preferably used power for generating an airflow present in the cleaning head would no longer be concentrated on the place of emanation of the contaminants and suspended matter (or the like). At the same time, the cleaning nozzles attached outside the cleaning head are located at a position that is protected from being contaminated. Moreover, this arrangement makes possible smaller diameters of the cleaning head and the main opening and, consequently, a much simpler design and greater effect of an airflow, present in the cleaning head, upon the area of the points of impact of the cleaning jets that are provided. Energy savings are the positive consequence. It is furthermore advantageous that the points of impact of the high-pressure jets—depending on the size of the inlet openings in the cleaning head—are still easily adjustable and/or displaceable. Cleaning can even be realized with a turbulent jet from outside of the cleaning head. The entire system is flexibly adaptable to various requirements.

In a further exemplary embodiment of the present invention, when more than one cleaning nozzle (40) is present, the cleaning nozzles (40) are distributed around the cleaning head (80) and are oriented such that the high-pressure jets (60) generated by the cleaning nozzles (40) strike a portion of the conveyor belt (1) that lies inside the imaginary projection of the contour of the main opening (81) onto the conveyor belt (1).

Preferably, the cleaning nozzles are distributed around the cleaning head at equal distances from one another. Particularly preferably, the cleaning nozzles are distributed around more than half the circumference of the cleaning head. Particularly preferably, three cleaning nozzles are disposed. Preferably, the number of cleaning nozzles present is equal to the number of inlet openings present. Preferably, the cleaning nozzles are oriented such that only one cleaning nozzle is respectively assigned to one inlet opening.

Advantageously, the cleaning nozzles are oriented such that the generated high-pressure jets strike the conveyor belt from different directions, preferably on a line parallel to the moving direction of the conveyor belt. Advantageously, the cleaning nozzles are oriented onto a small, preferably elliptical surface area on the conveyor belt in the range of, preferably, 1 $mm^2$ and 8 $mm^2$, particularly preferably of 2 $mm^2$ and 4 $mm^2$, preferably in the area of the central axis of the main opening.

Thus, only a small surface area is wetted by the liquid, and the jet energy is applied in a concentrated manner. Preferably, all points of impact of the high-pressure jets are located within a circular surface area having a radius of preferably 5 cm, particularly preferably 16 mm, even more particularly preferably 5 mm.

Preferably, the cleaning nozzles are oriented onto points that have a respective distance from one another of not more than 1 cm, preferably not more than 5 mm, particularly preferably not more than 3 mm, even more particularly preferably not more than 2 mm.

By spraying only a small portion of the conveyor belt, only a small area of the conveyor belt is wetted with liquid, and the jet energy is concentrated onto a small surface area. This increases the cleaning power and, at the same time, a subsequent autonomous drying, or a drying carried out by a drying device, can be performed more effectively, since only a small area has to be dried. An effective drying is very advantageous for a drying screen, since a drying screen that has not been dried thoroughly and uniformly can give rise to water marks in the newly produced paper web, and the quality of the paper is thereby impaired.

In case three cleaning nozzles are used, the cleaning nozzles are preferably oriented (see FIG. 7) such that, preferably, the first two cleaning nozzles are opposite one another transversely to the moving direction of the conveyor belt, and are preferably oriented along two points whose imaginary connecting line is preferably parallel to the moving direction of the conveyor belt and has a length in the range from preferably 0.5 mm to 3 mm, particularly preferably 1 mm to 2 mm. For the nozzles, an angle W1 is set in the range of preferably x±45°, particularly preferably x±15°, even more particularly preferably x±5°, wherein x=90° for one nozzle and x=270° for the opposing nozzle. The third cleaning nozzle is oriented along a third point. Preferably, the third point is located in the moving direction of the conveyor belt, preferably after the point of impact of the first two cleaning nozzles, at a distance of preferably 0.5 mm to 3 mm, particularly preferably 1 mm to 2 mm. Preferably, W1 for the alignment of the third nozzle is 180±5°, particularly preferably 180±2.15°, even more particularly preferably 180±0.1°. For one of the provided cleaning nozzles, W2 falls, respectively, in the range from preferably 5° to 85°, particularly preferably 10° to 60°, even more particularly preferably 15° to 45°.

In a further exemplary embodiment of the present invention, the cleaning nozzles (40) are oriented such that the high-pressure jets (60) have a common point of impact (61) on the conveyor belt (1).

Preferably, the high-pressure jets are oriented approximately onto a common point of impact.

In a further exemplary embodiment of the present invention, at least one of the provided cleaning nozzles (40) is adapted to generate a laminar high-pressure jet (60).

In a further exemplary embodiment of the present invention, the cleaning apparatus (20) has a temperature control unit (70) for controlling the temperature of the high-pressure jets (70).

The temperature control unit is preferably disposed in the area of the high-power pump. Preferably, the temperature control unit has a continuous flow heater for controlling the temperature of the high-pressure jets.

In a further exemplary embodiment of the present invention, the temperature control unit (70) includes a heat exchanger (71). In a further exemplary embodiment of the present invention, at least one device (100) for supplying compressed air (101) is disposed in the area of at least one point of impact (61) of at least one high-pressure jet (60) on the conveyor belt.

The device for supplying compressed air is preferably a preferably annular hollow body (torus, or "doughnut"), which preferably has a connector for a compressed-air hose, particularly preferably a duct for supplying compressed air from a compressed-air pump or compressed-air source to the hollow body. Preferably, the device for supplying compressed air is disposed at a distance of between 25 mm and 250 mm, particularly preferably between 100 mm and 130 mm, from at least one point of impact. Preferably, it is disposed on the same side of the conveyor belt on which the cleaning nozzle is disposed. Preferably, the shape of the hollow body matches the shape of the main opening of the cleaning head. The device for supplying compressed air is: preferably disposed at the main opening; preferably fastened to the main opening without an intervening space; preferably realized in one structural unit with the cleaning head.

In a further exemplary embodiment of the present invention, the device (100) for supplying compressed air (101) has at least one air-supply opening (102), wherein the provided air-supply openings (102) are disposed such that the supplied compressed air (101) forms an air curtain (103), which steers the liquid ricocheting off the conveyor belt (1) towards the main opening (81).

Air-supply openings are preferably small holes and/or slots. Preferably, they have a diameter in the range from preferably 0.1 mm to 1.5 mm, particularly preferably 0.3 mm to 1 mm, and even more particularly preferably between 0.35 mm and 0.8 mm, particularly preferably a diameter of approximately 0.4 mm. In a preferred embodiment of the device for supplying compressed air as a preferably annular hollow space, compressed air is suppliable into the hollow space via the provided connector, and then out of the hollow space through the air-supply openings. Preferably, the air-supply openings are disposed and oriented such that the gap between the device for supplying compressed air and the conveyor belt is shieldable by compressed air.

In a further exemplary embodiment of the present invention, the device (100) for supplying compressed air (101) is disposed such that air-supply openings (102), which are oriented substantially onto a point within an imaginary extension of the cleaning head (80), are distributed around the edge of the main opening (81).

Preferably, a hollow body, which matches the shape of the main opening and which is preferably disposed at the edge of the main opening, is provided with air-supply openings. Preferably, the hollow body is disposed at the main opening outside the cleaning head. Preferably, the hollow body encircles the cleaning head. The air-supply openings are preferably disposed such that they enclose, with the plane of the conveyor belt, an angle of between 15° and 45°, particularly preferably an angle of approximately 30°. They are oriented such that the individual compressed-air jets converge towards the central axis of the cleaning head. Preferably, 6 to 30, particularly preferably approximately 12, air-supply openings are disposed, preferably at equal distances from one another, in the device for supplying compressed air.

In a further exemplary embodiment of the present invention, a device (120) for supplying at least one water jet (121) is provided inside the cleaning head (80), wherein the generated water jets (121) are oriented substantially in a direction towards the discharge opening (84).

The device for supplying at least one water jet is preferably a preferably annular body, which is located in the cleaning head and which preferably has holes as small water nozzles. Pressurized water can be supplied into the body, and exists through the provided holes. They have a diameter, preferably, of 0.5 mm to 1.5 mm, particularly preferably of approximately 0.8 mm. Preferably, the holes are oriented such that they generate a water jet that extends substantially parallel to the inner wall of the cleaning head in the direction of the airflow within the cleaning head. The device for supplying at least one water jet is preferably attached to the inner wall of the cleaning head and is preferably extended encircling the inner wall. It is adapted such that, insofar as possible, it does not substantially impair, as a result of its structural shape, the airflow inside the cleaning head. Preferably, it is disposed over the provided inlet openings for the high-pressure jets. It is preferably provided as a rinsing device.

In a further exemplary embodiment of the present invention, a device (140) for supplying compressed air (141) is provided inside the cleaning head (80).

The possible embodiments of the just described device for supplying at least one water jet also apply to the supply of compressed air attached within the cleaning head. The device for supplying compressed air, however, preferably has a connector for supplying compressed air. Particularly preferably, compressed air is suppliable via a duct. Preferably, the holes are oriented, and preferably as small compressed-air nozzles, such that they generate at least one compressed-air jet, which extends substantially parallel to the inner wall of the cleaning head in a direction towards the discharge opening, i.e. preferably in the direction of an airflow generated in the cleaning head, or which, particularly preferably, extends substantially in a spiral shaped manner along the inner wall of the cleaning head and propagates towards the discharge opening. Preferably, for the spiral-shaped course of the compressed air, the holes are disposed slightly obliquely relative to an imaginary transverse plane through the cleaning head.

Particularly preferably, the described device for supplying at least one water jet and the supply of compressed air attached within the cleaning head are realized in one structural unit. The cleaning head is preferably attached, at the discharge opening, to a collection system for discharging dirt and spray water.

In a further exemplary embodiment of the present invention, the cleaning apparatus (20) has a drying unit (160) spaced apart from the cleaning head (80) in the moving direction of the conveyor belt (1).

The drying unit preferably has means for drying the conveyor belt. Preferably, the drying unit is at the same position transversely relative to the conveyor belt as the points on the conveyor belt targeted by the provided cleaning nozzles. Particularly preferably, the drying unit is disposed at the same position transversely relative to the conveyor belt as the center point of the main opening, i.e. disposed in a line with the center point of the main opening, parallel to the moving direction. Preferably, the drying unit is attached to the cleaning head.

In a further exemplary embodiment of the present invention, the drying unit (160) includes at least one air nozzle (161) directed onto the conveyor belt (1).

Preferably the provided air nozzles are each attached, preferably in groups, to a holder, by which the provided air nozzles can be oriented onto the conveyor belt. Preferably, the drying unit includes a plurality of air nozzles in a row, preferably a plurality of rows, along the moving direction of the conveyor belt. Particularly preferably, the drying unit has two rows of air nozzles along the moving direction of the conveyor belt, each row preferably having two air nozzles. Preferably, different rows are disposed with an offset relative to one another.

The air nozzles provided on the drying unit are preferably adapted to generate an airflow that is narrow at the nozzle opening and is wide at a greater distance from the air nozzle, particularly preferably a conical airflow. Preferably, they are adapted to generate an air-pressure jet, particularly preferably using compressed air in the range from preferably 0.5 bar to 6 bar, particularly preferably using compressed air of approximately 4 bar. They are preferably disposed such that the generated air jets strike the areas wetted with liquid by the cleaning nozzles.

In a further exemplary embodiment of the present invention, when more than one air nozzle (161) is provided, the provided air nozzles (161) are disposed such that they are oriented onto the conveyor belt (1) from at least two different directions.

Preferably, the provided air nozzles are disposed such that the jet profiles also overlap, at least partially. Particularly preferably, the provided air nozzles are disposed such that they are oriented onto a common surface from at least two different directions.

In a further exemplary embodiment of the present invention, at least the cleaning head (80) and at least one of the provided cleaning nozzles (40) are attached to a carrier device (180) and are transversely movable relative to the moving direction of the conveyor belt (1).

Furthermore, the object is achieved by a method according to the invention for cleaning a conveyor belt (1) of a drying screen in a paper production system having a cleaning apparatus (20), wherein the cleaning apparatus has a cleaning head (80), which has an interior space, a discharge opening (84), and a main opening (81) that faces towards the conveyor belt (1), comprising the step spraying the conveyor belt (1) with at least one high-pressure jet (60) of a liquid, which is preferably generated by a cleaning nozzle (40) at a position outside of the cleaning head (80).

By generating the high-pressure jet at a position outside of the cleaning head, the dirt and/or suspended matter, etc. caught by the cleaning head cannot contaminate the cleaning nozzle. In particular, an airflow, which is preferably provided in the interior space of the cleaning head, cannot contaminate the cleaning nozzle with entrained dirt and/or suspended matter, etc.

In a further preferred method, the cleaning head (80) additionally has at least one inlet opening (82) in the wall of the cleaning head (80), and at least one high-pressure jet (60) sprays onto the conveyor belt (1) from the outside through one of the inlet openings (82) provided in the cleaning head (80).

The spraying through the cleaning head enables that the main opening can be positioned very close to the belt. Nevertheless, the provided high-pressure jets can be sprayed onto the conveyor belt at a preferably acute angle between the surface normal with respect to the conveyor belt and the high-pressure jet. If the main opening is located close to the conveyor belt, such that there is only a small gap, of preferably 5 mm to 20 mm, particularly preferably 8 mm to 14 mm, even more particularly preferably of approximately 10 mm between the conveyor belt and the edge of the main opening, on the one hand the spray water and the produced dirt is caught by the encircling of the surface, which is just being cleaned. On the other hand, if a negative pressure is preferably generated at the discharge opening of the cleaning head, a stronger suction exists close to the emanation of the spray water and the dirt at an equal suctioning power, wherein the negative pressure causes an airflow as a suction from the main opening towards the discharge opening. Moreover, if a positive pressure is particularly preferably generated in the portion of the interior space of the cleaning head that is close to the main opening by means of a device for supplying compressed air, the airflow generated thereby is substantially greater towards the discharge opening, since a leakage of the air is substantially prevented through the now small gap between the main opening and the conveyor belt.

In a further preferred method, when the conveyor belt (1) is sprayed by more than one high-pressure jet (60), the high-pressure jets (60) spray from different directions onto the conveyor belt.

Preferably, the high-pressure jets spray onto the belt such that the jets penetrate into the various depressions and/or pores of the conveyor belt. Particularly preferably, the high-pressure jets spray a line parallel to the moving direction of the conveyor belt, such that a point of the conveyor belt is cleaned by high-pressure jets from different directions by the motion of the conveyor belt in a preferably short interval of time. Preferably, the provided high-pressure jets spray onto an area located close to the center of the outline of the main opening projected onto the conveyor belt. The high-pressure jets preferably perform an approximately localized cleaning of the conveyor belt.

In a further preferred method, the high-pressure jets (60) strike the conveyor belt (1) at a common point of impact (61).

Preferably, as a result, the conveyor belt is cleaned simultaneously at one point by high-pressure jets from different directions.

In a further preferred method, in addition the liquid provided for the high-pressure jets (60) is heated.

Preferably, the liquid is heated to a range of between 20° and 200°. Particularly preferably, the liquid is heated to approximately 60°. Consequently, there is substantially less capillary action in the screen, and the after-drying is thereby substantially assisted.

In a further preferred method, in addition a negative-pressure source is connected to the discharge opening of the cleaning head (80), such that an airflow (83) is generated from the main opening (81) towards the interior of the cleaning head (80).

The airflow imitates the principle of the vacuum cleaner. The cleaning head used here could be compared in an exemplary manner with a wet vacuum cleaner. Preferably, the suction effect also causes a suctioning of the air and/or the water that is present on the other side of the conveyor belt from the cleaning head. The negative-pressure source is, for example, a suction pump.

In a further preferred method, the airflow (83) transports away dirt and/or used water.

Dirt is, in particular, the dirt particles detached from the conveyor belt by the cleaning operation.

Preferably, the airflow conveys dirt and/or used water away, preferably via a tube system of the carrier device. Preferably, the used water is processed for reuse.

In a further preferred method, in addition compressed air (101) is supplied via a device (100) for supplying compressed air in the area of at least one point of impact (61), such that the liquid ricocheting off the conveyor belt (1) is steered towards the main opening (81) by the supplied compressed air (101).

Preferably, the compressed air is supplied at the main opening. Preferably, the compressed air is supplied such that an air curtain forms around the high-pressure jets striking the conveyor belt. Preferably, compressed air is supplied at the main opening via a plurality of air-pressure jets, the supplied compressed air preferably converging towards the center of the main opening and preferably generating a strong airflow towards the discharge opening of the cleaning head. Preferably, spray water, which, as known from experience, diverges parallel to the surface of the conveyor belt, and preferably dirt, which mixes with the spray water, are steered into the cleaning head by the supplied compressed air. Preferably, compressed air is used in the range from preferably 1 bar to 600 bar, preferably 3 bar to 30 bar, particularly preferably 5 bar to 12 bar, quite particularly preferably approximately 6 bar. These ranges preferably also apply to compressed air that is supplied by a device for supplying in the interior of the cleaning head and/or that is used by one or more air nozzles of a drying unit for drying the conveyor belt. The devices for supplying compressed air and the drying unit are preferably adapted for the use of appropriate pressures.

In a further preferred method, by supplying compressed air, a positive pressure is generated in the area of at least one point of impact (61), wherein the positive pressure also spreads into the interior space of the cleaning head (80) and generates an airflow (83) that transports away the ricocheting-off liquid through the interior space of the cleaning head (80).

The positive pressure is preferably in the same ranges as the compressed air supplied to generate the air curtain.

The area of at least one point of impact is preferably the space enclosed by the generated air curtain. Preferably, the area of at least one point of impact is approximately the main opening of the cleaning head.

The spreading of the positive pressure into the interior space of the cleaning head is preferably effected as far as the discharge opening, after which an air pressure that is slightly above or equal to the ambient air pressure, or normal pressure, ensues. Thus, the air pressure preferably decreases in the interior space of the cleaning head, from the area of at least one point of impact as far as the discharge opening, since an equalization of positive pressure and the ambient air pressure is effected via the discharge opening.

It has been surprisingly discovered that the supplying of compressed air can result in such a positive pressure being generated in the area of at least one point of impact, and that this positive pressure generates an airflow through the interior space of the cleaning head. This airflow is sufficient to transport dirt and spray water as far as the discharge opening. That is to say, the positive pressure pushes the dirt and the spray water out of the cleaning head towards the discharge opening. In this case, for example, even a vertical transport path against gravity of more than 50 cm can be spanned with a pressure of approximately 6 bar.

Moreover, it is particularly advantageous in this case if the cleaning head has a short distance to the conveyor belt. This short distance is rendered possible, preferably, by the inlet openings present in the cleaning head. Contrary to the expectation of persons skilled in the art, an airflow, which is caused by the positive pressure and by which dirt and spray water can be transported away to the discharge opening, ensues in the interior space of the cleaning head, in spite of the inlet openings that are preferably present. A person skilled in the art would expect that the generated positive pressure would leak through the inlet openings and/or the gap between the main opening of the cleaning head and the conveyor belt, and consequently would not generate a sufficient airflow inside the cleaning head, and would thus disregard the generation of a positive pressure in the interior space of the cleaning head. A great advantage of this type of generation of an airflow in the interior space of the cleaning head is that, preferably, it is possible to omit devices for generating a negative pressure, i.e., for example, suction pumps. Positive-pressure sources are usually already present in the (paper production) factory, but negative-pressure sources are seldom present. Preferably, it is also possible to combine the generation of a positive pressure in the interior space of the cleaning head and the connecting of a negative-pressure source to the discharge opening, as a result of which the airflow in the interior space can be boosted, although an additional component (negative-pressure source) is required for this purpose.

In a further preferred method, in addition at least one water jet (121), which transports away dirt and used water, is generated inside the cleaning head (80).

The water jet is preferably generated in the direction of the airflow within the cleaning head. Preferably, a plurality of water jets is generated within the cleaning head, preferably in the form of a ring on the inner wall of the cleaning head. Preferably, dirt accumulations on the inner wall of the cleaning head are detached by the at least one water jet and are transported further in the direction of the airflow. Preferably, a water pressure of 4 bar to 6 bar, particularly preferably a water pressure of 5 bar, is used for this purpose.

In a further preferred method, in addition compressed air (141), which transports away dirt and used water, is supplied inside the cleaning head (80).

The effect of the previously-described at least one water jet is preferably achieved in a like manner by the supplied compressed air in the interior of the cleaning head. Particularly preferably, the effect is boosted by the combined supplying of compressed air and at least one water jet. The used water and the detached dirt particles are preferably transported away through the discharge opening, preferably into a collection duct. This collection duct is preferably washed out from time to time by stationary nozzles.

In a further preferred method, the compressed air (141) is supplied in the interior of the cleaning head (80) such that an air vortex forms.

Preferably, the air vortex is generated through the use of a plurality of compressed-air nozzles in the interior of the cleaning head, which spray compressed air onto the inner wall of the cleaning head in a slightly oblique manner, such that it propagates in a slightly spiral manner in the direction of the airflow in the interior of the cleaning head. By this effect, the water and dirt that are present are preferably swirled and transported away with the airflow. Preferably, a Venturi effect is generated by at least one alteration of the cross-section of the cleaning head in the interior of the cleaning head.

In a further preferred method, in addition, after the conveyor belt (1) has been sprayed by at least one high-pressure jet (60) of a liquid, the conveyor belt (1) is dried by a drying unit (160) located downstream in the moving direction.

Preferably, the portion of the conveyor belt, which has just been cleaned, is dried by the drying unit.

In a further preferred method, the drying unit (160) sprays at least one compressed-air jet (162) onto at least one area of the conveyor belt (1).

Preferably, at least one conical compressed-air jet is generated using a correspondingly-adapted nozzle. The compressed air removes the water present in the conveyor belt, or the liquid used for cleaning the conveyor belt.

In a further preferred method, when more than one compressed-air jet (162) is used, the compressed-air jets (162) spray onto portions of the conveyor belt (1) from at least two different directions.

Preferably, the different compressed-air jets strike the belt such that depressions and/or pores present in the conveyor belt are sprayed with compressed air from different directions. Preferably, over time, one point on the conveyor belt is successively sprayed—due to its motion relative to the drying unit—by the drying unit with compressed air from different directions. The angle (analogous to W2) formed by the air jets and the surface of the conveyor belt is preferably in the range of between 15° and 45°, particularly preferably it is 30°. The pressure used to generate these air jets is preferably in a range from 0.5 bar to 6 bar, particularly preferably it is 4 bar.

BRIEF DESCRIPTION OF THE DRAWINGS

In a further preferred method, when more than one compressed-air jet (162) is used, the portions of the conveyor belt (1) sprayed by the compressed-air jets (162) overlap, at least partially.

DETAILED DESCRIPTION OF THE DRAWINGS

With the described method, a cleaning of the conveyor belt is possible with a minimum expenditure of energy for the generation of compressed air and high-pressure jets, and with a minimum water consumption.

The invention shall now be further illustrated in an exemplary manner with reference to drawings.

Figure 1:
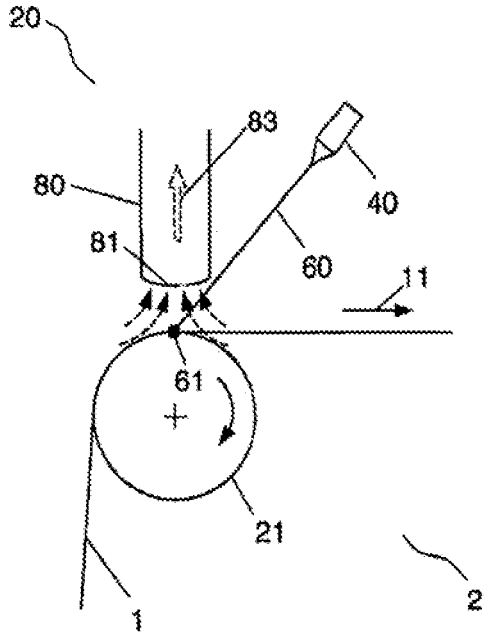
Figure 2:
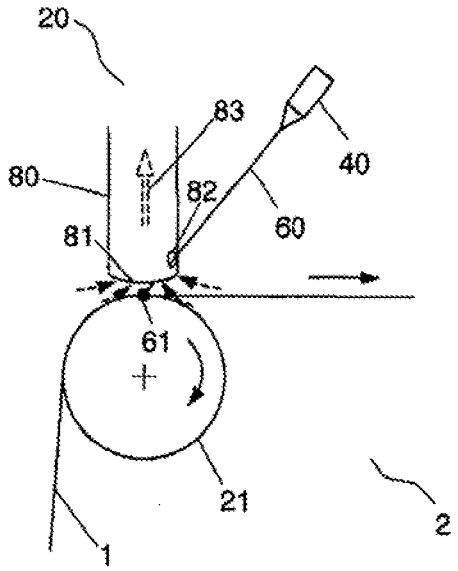
Figure 3A:
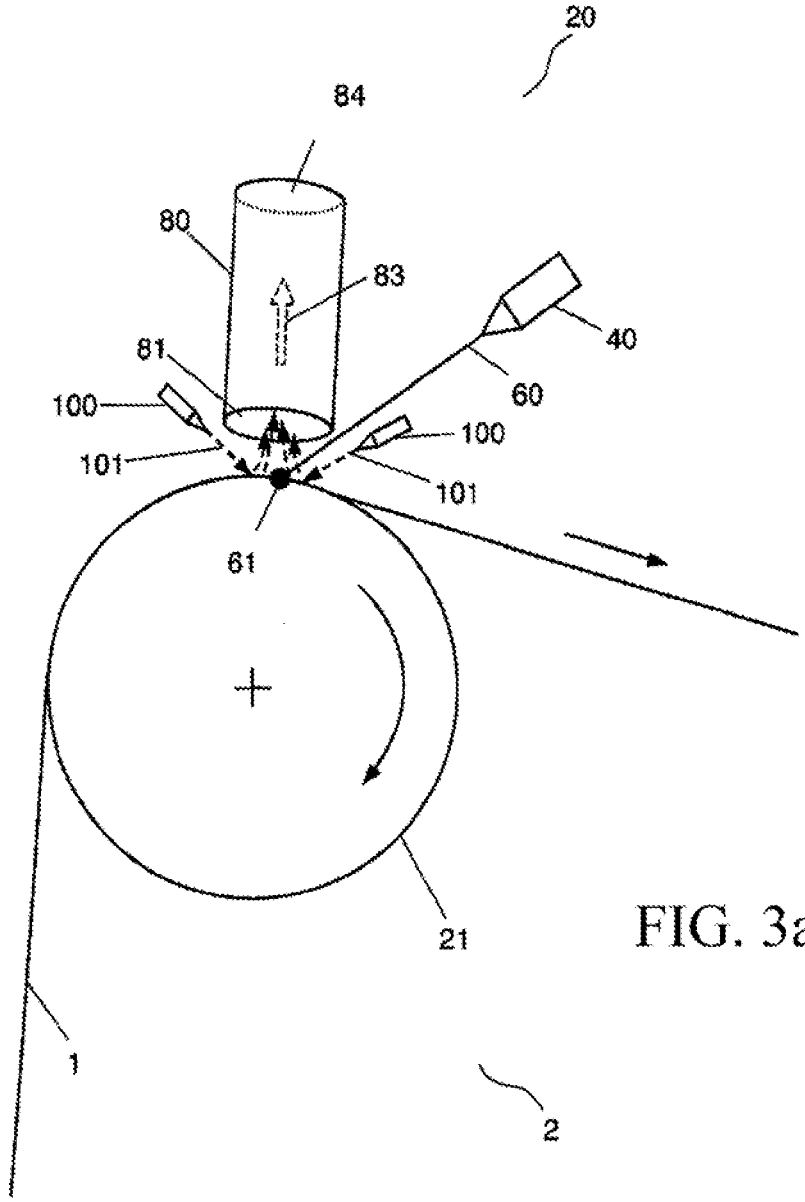
Figure 4:
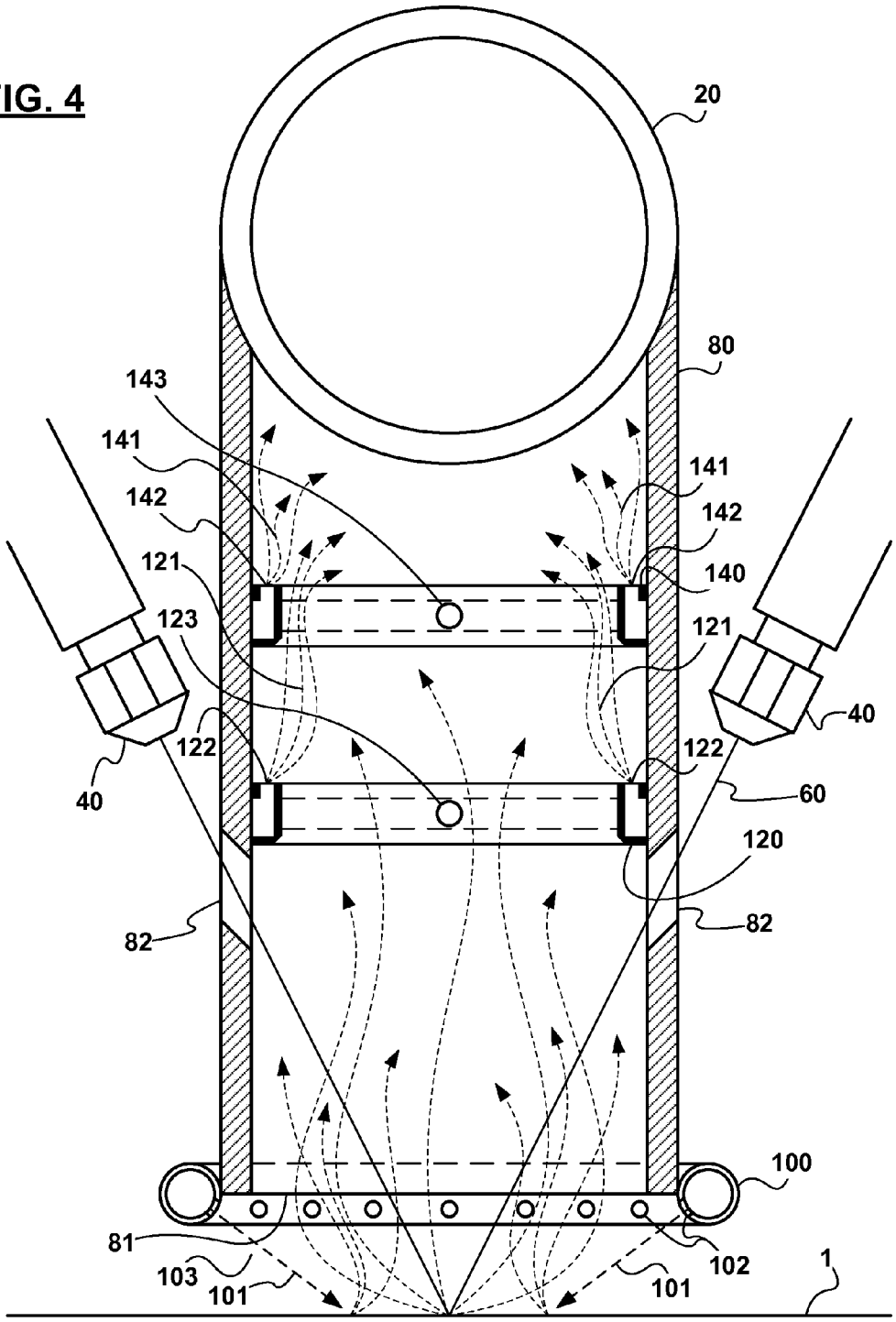
Figure 5:
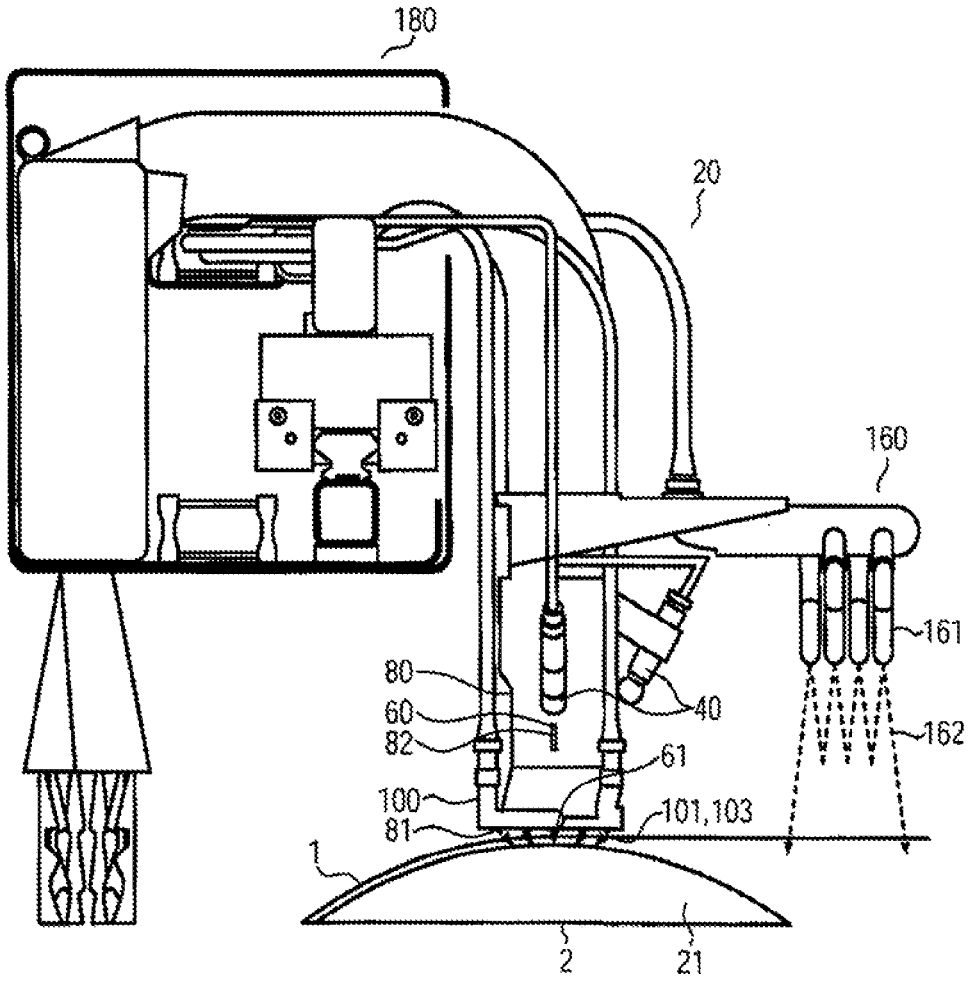
Figure 6:
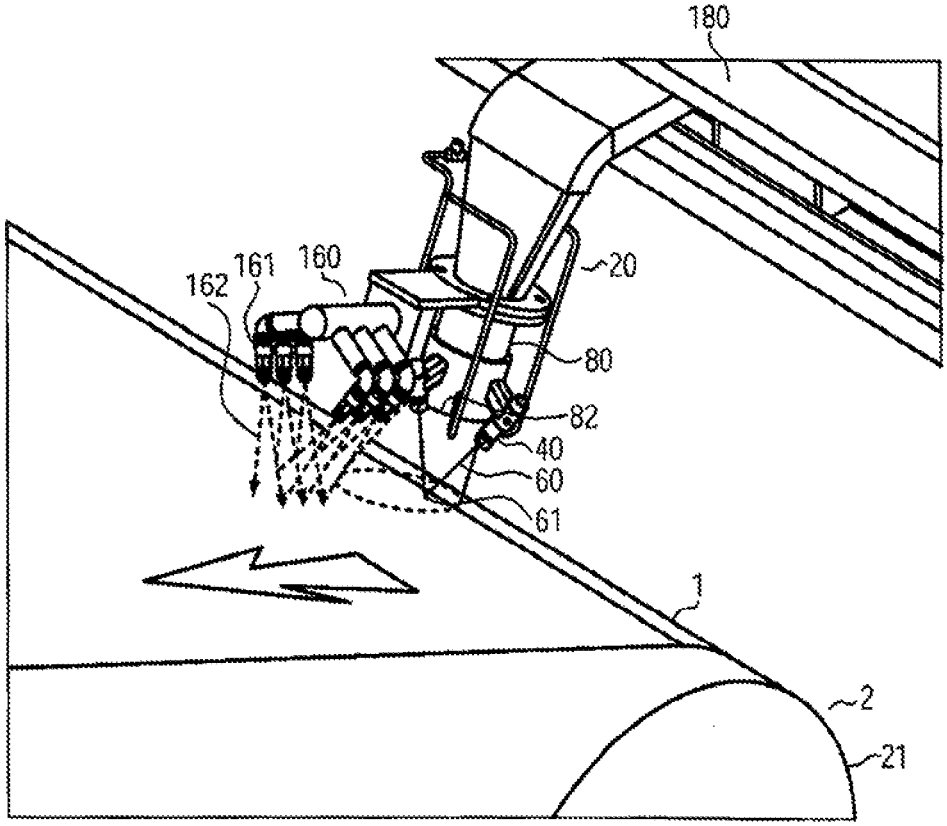
Figure 7:
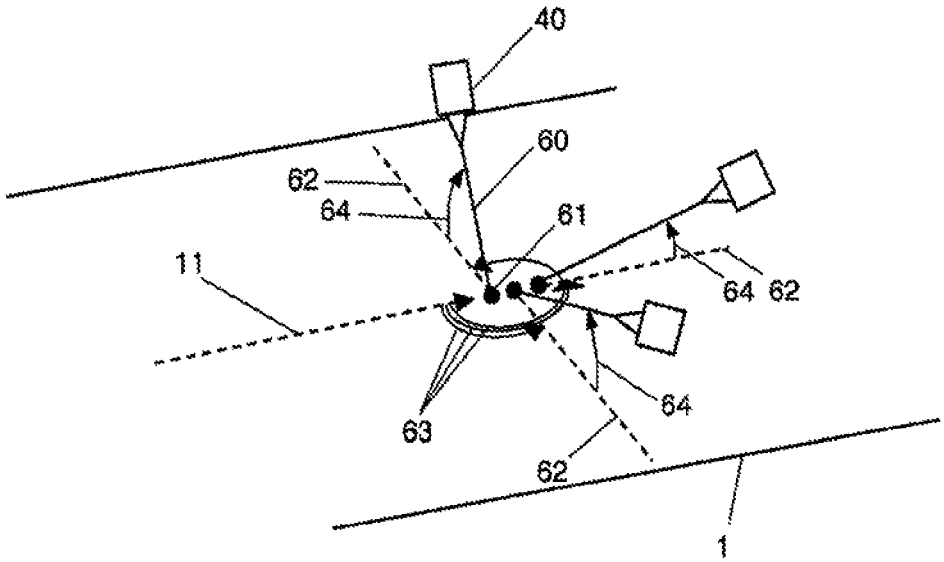

FIG. 1 shows a view of an apparatus according to the invention, having a cleaning head and a cleaning nozzle disposed outside of the cleaning head, FIG. 2 shows a view of an apparatus according to the invention, having a cleaning head and a cleaning nozzle disposed outside of the cleaning head, wherein the cleaning head has an inlet opening for the high-pressure jet generated by the cleaning nozzle, FIGS. 3*a/b* show a view of an apparatus according to the invention, having a cleaning head, a cleaning nozzle disposed outside of the cleaning head, and a device for supplying compressed air in the area of the point of impact of the high-pressure jet on the conveyor belt, without (3*a*) and with (3*b*) an inlet opening for the high-pressure jet, FIG. 4 shows a cross-section of an apparatus according to the invention, having a cleaning head, a plurality of cleaning nozzles disposed outside of the cleaning head, a device for supplying compressed air in the area of the point of impact of the high-pressure jet on the conveyor belt, a device for supplying water jets in the interior of the cleaning head, and a device for supplying compressed air in the interior of the cleaning head, FIG. 5 shows an illustration of an apparatus according to the invention, which additionally has a drying unit, FIG. 6 shows an illustration of an apparatus according to the invention, which additionally has a drying unit, but which does not have a device for supplying compressed air in the area of the point of impact of the high-pressure jet on the conveyor belt, and FIG. 7 shows an auxiliary view, which illustrates, in a manner that is neither true to scale nor angle-accurate, the definition for angles of the orientation relative to one or more nozzles.

In FIG. 1 a portion of a paper production system 2 is represented, which is insinuated by a conveyor belt 1 (drawn in cross-section only) running over a roller 21. The cleaning apparatus 20 according to the invention is shown in a slightly perspective representation. In this exemplary embodiment, it is comprised of a cleaning head 80, which is shown here as a portion of a cylinder. The cleaning head 80 is open at the underside. This opening is the main opening 81. The cleaning head is disposed perpendicularly at a distance of 35 mm above the conveyor belt. Further, a cleaning nozzle 40 is a part of the cleaning apparatus 20, which cleaning nozzle is oriented toward the conveyor belt and is disposed outside the cleaning head 80. A hose (not shown) connects the cleaning nozzle 40 to a high-pressure pump (not shown). Here, the point of impact 61 and the central axis of the cleaning head are located on the tangential line of the conveyor belt 1 that is moving off of the roller 21.

During operation of the cleaning apparatus 20, an airflow 83 in the interior of the cleaning head is adjusted using a pump connected to the discharge opening 84 or another means for generating a suction—these components are not shown here. As a result, an airflow 83, indicated by a broken-line arrow, is produced in the interior. Air, indicated by broken-line arrows in the direction of the main opening 81, is suctioned from the outside of the tube through the main opening 81. At the same time, a high-pressure jet 60 comprised of water is generated using the cleaning nozzle 40 and not-depicted pump means. This high-pressure jet has a diameter of 0.15 mm, sprays onto the conveyor belt 1 and strikes there at the point of impact 61.

Due to this arrangement, the belt is cleaned of contaminants at the point of impact 61 by the high-pressure jet 60. Since the conveyor belt 1 is moving, it is thus cleaned continuously. The dirt particles detached from the conveyor belt 1 and the spray water produced during the cleaning operation are caught by the cleaning head and transported away by the airflow 83. The detached dirt particles are thus not re-deposited on the belt and, after recycling, the water used for the cleaning can for the most part continue to be used for cleaning. Due to the arrangement of the cleaning nozzle 40 outside the cleaning head 80, the cleaning nozzle is not exposed to the airflow 83, which transports dirt particles. Contamination of the cleaning nozzle 40 by detached dirt particles is thus prevented by this arrangement.

In FIG. 2 a cleaning apparatus according to the invention similar to that of FIG. 1 is shown, with the difference that an inlet opening 82 is now provided in the cleaning head. This inlet opening 82 is an oblique bore having the diameter of 0.25 mm. Furthermore, a difference, compared with FIG. 1, is that the cleaning head is now disposed at a distance of 10 mm from the conveyor belt.

During operation of the cleaning apparatus 20, an airflow 83 is again generated inside the cleaning head 80, and a high-pressure jet 60 is generated (see the description of FIG. 1). A difference in this case, however, is that the high-pressure jet 60 strikes the conveyor belt 1 at the point of impact 61 through the inlet opening 82 and, consequently, also through the main opening 81.

Due to the presence of the inlet opening 81, a smaller distance of the cleaning head 80 to the conveyor belt is possible in this exemplary embodiment. The airflow 83 resulting from the suction thus acts even more strongly at the point of impact 61, at the place of origin of the spray water and the dirt particles. Both the spray water and the dirt particles can therefore be transported away more effectively via the cleaning head 80. Moreover, the cleaning nozzle 40 is now even better protected against contamination by the dirt particles, since the cleaning head 80 acts like a protective shield for the cleaning nozzle 40.

In FIG. 3*a* the cleaning apparatus 20 according to the invention similar to that of FIG. 1 is shown, with the important difference that now two devices 100 for supplying compressed air 101 are additionally disposed in the area of the point of impact 61. These devices are indicated as air-pressure nozzles 100. The air-pressure nozzles are each fed via a hose (not shown), which conducts compressed air. Here, the point of impact 61 and the central axis of the cleaning head are located in front of the tangential line of the conveyor belt 1 that is moving off of the roller 21, at a point at which the conveyor belt 1 is supported on the roller.

During operation of the cleaning apparatus 20, the air-pressure nozzles each spray an air-pressure jet 101 against the conveyor belt, such that the spray water, which during operation usually carries away the detached dirt particles with it and also sprays them away from the point of impact 61 substantially parallel to the conveyor belt 1, strikes the air-pressure jets 101. The spray water ricochets off the air-pressure jets 101 and is thus steered into the direction of the main opening 81. The air jets 101 are also steered by the conveyor belt 1 into the direction of the main opening 81. The coincidence of the air jets 101 and the air jets deflected at the material web generates a positive pressure, which generates an airflow 83 substantially vertically upwards inside the cleaning head 80. With this airflow 83, the dirt that has been caught and the spray water are pushed upwards towards and through the discharge opening 84.

A steering of the spray water and the detached dirt particles towards the main opening 81 is facilitated by the additionally attached device 100 for supplying compressed air 101. The airflow 83 generated in this case can therefore very effectively entrain the spray water and dirt particles. The wastage of spray-water and the risk of re-contaminating the conveyor belt 1 or the cleaning nozzle 40 with detached dirt particles are greatly reduced. Moreover, simultaneous shielding of the spray water and dirty water, as well as their removal, is achieved merely through the use of compressed air. There is no need for negative pressure inside the cleaning head 80 in order to suction away spray water and dirty water.

Figure 3B:
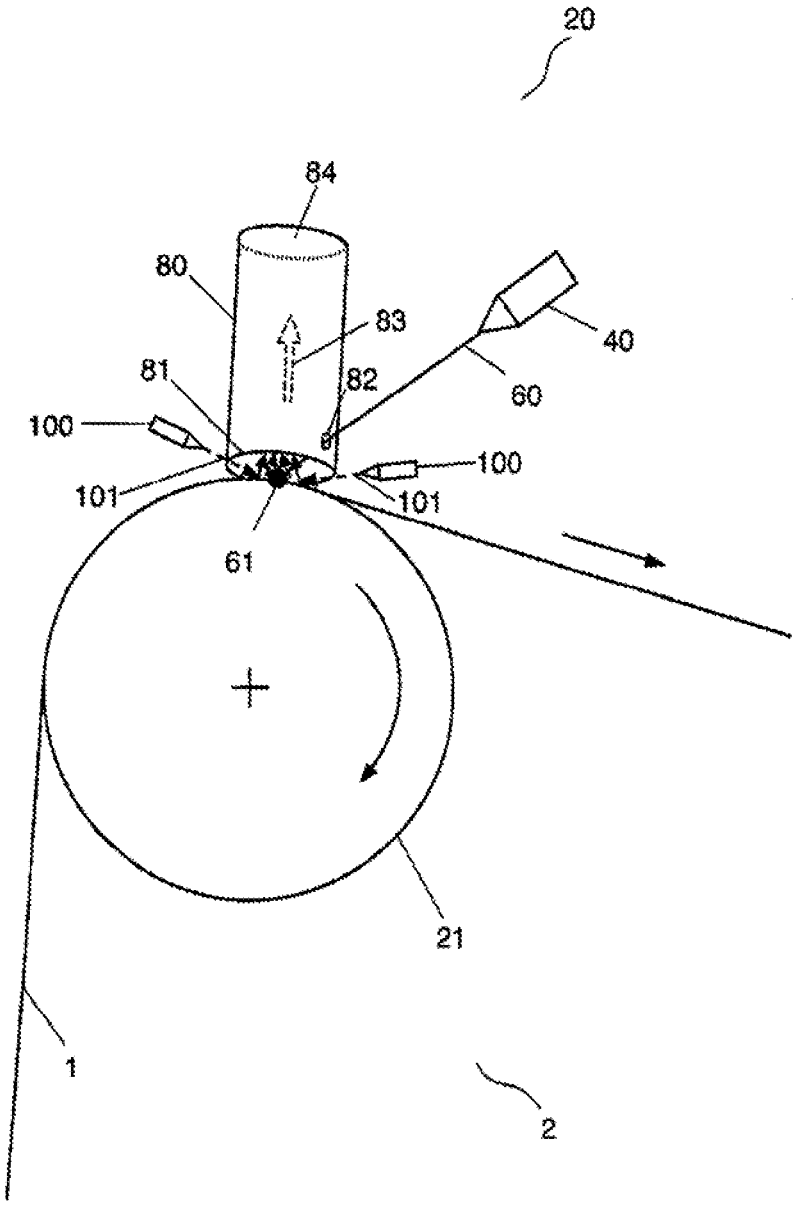

In FIG. 3*b* a cleaning apparatus 20 according to the invention similar to that of FIG. 3*a* is shown, with the difference that the cleaning jet 60 sprays onto the conveyor belt 1 through an inlet opening 82, and this allows a closer positioning of the main opening 81 to the point of impact 61 for the same spraying angle of the cleaning jet 60 onto the conveyor belt 1.

During operation of the cleaning apparatus 20, an even stronger airflow 83 can be produced due to the even smaller gap between the cleaning head and the conveyor belt 1, since the positive pressure produced by the compressed air jets 101 in the area of the main opening 81 is forced yet more strongly to equalize to the ambient pressure via the discharge opening 84, and not via a different path. Moreover, yet more advantageously, dirty water and spray water are actually caught directly by the cleaning head 80.

A further embodiment example of the cleaning apparatus 20 according to the invention is illustrated in FIG. 4. A view of the interior of the cleaning head 80 (diameter: 228 mm; distance to the conveyor belt 1, not shown: 10 mm) and of the components attached thereto is depicted:

A device 100 for supplying compressed air 101 is attached to the main opening 81. This device is an annular hollow body, which is attached to the outer radius of the cleaning head 80 and surrounds the main opening 81, having equally-spaced-apart, drilled holes as air-supply openings 102 with the diameter 0.8 mm. The holes are drilled at an angle of 30° relative to the plane of the conveyor belt 1. This hollow body is a tube bent into a ring, whose ends are welded to one another in an airtight manner, and into which tube, holes as air-supply openings and a connection hole for supplying compressed air are drilled. To produce one of these air-supply openings, the tube forming the ring is first bored completely through by a bore hole made on the outside of the ring, such that two holes result in the tube envelope from one bore hole. The exit hole on the inside of the ring is oriented obliquely downwards towards the center point of the ring. The burr on this hole is therefore not on the tube surface located in the hollow space of the ring, but rather on the outer surface. As a result, the burr can be removed cleanly. The other, opposing hole in the tube cross-section is closed by welding. In this way, a clean bore is obtained, which can serve as an air-supply opening. If a hole having a burr located in the hollow space of the ring were to be used, impurities in the compressed air could attach to the burr over time, and the hole would become blocked after a certain period of time.

The cleaning head has two lateral inlet openings 82.

As a device 120 for supplying water jets 121 in the interior of the cleaning head 80, a hollow annular body having equally-spaced-apart drilled holes as water-jet openings 122 with the diameter 0.8 mm is attached directly above the inlet openings 82. The holes are drilled vertically upwards and parallel to the inner wall of the cleaning head 80. A water connector 123 is present on the annular body.

As a device 140 for supplying compressed air 141 in the interior of the cleaning head 80, a hollow annular body having equally-spaced-apart, drilled holes as air-supply openings 142 with the diameter 0.8 mm is attached above the device 120 for supplying water jets 121. The holes are drilled vertically upwards and parallel to the inner wall of the cleaning head 80. A compressed-air connector 143 is present on the annular body.

In the uppermost region of the drawing, the cleaning head 80 has a bend of 90°.

Two opposing cleaning nozzles 40 for generating laminar high-pressure jets 60 are attached outside the cleaning head 80.

During operation of the cleaning apparatus 20, the cleaning nozzles 40 each spray a high-pressure jet 60 comprised of water at a pressure of 450 bar onto a common point of impact 61 from two different directions. The high-pressure jets 61 clean the belt. Furthermore, compressed air 101 (shown in an exemplary manner only for two air-supply openings 102, even though compressed air 101 flows out of all air-supply openings 102) is supplied via the air-supply openings 102 into the annular body of the device 100 for supplying compressed air 101. The individual jets of compressed air 101 produced thereby converge towards the vertical central axis of the cleaning head 80, and together form an air curtain 103, which encloses the produced spray water between the cleaning head 80 and the conveyor belt 1. Furthermore, the compressed air 101 is itself deflected and then acts in the direction of the interior space of the cleaning head 80. A strong vertical updraft (only partially indicated by broken-line arrows, wherein an arrow tip does not mean the end of the airflow) is produced in the interior of the cleaning head 80 as a result of the positive pressure in the interior of the cleaning head 80 that is generated by the compressed air of the air curtain 103. Due to the small gap between the conveyor belt 1 and the main opening 81, the positive pressure results in an airflow 83 towards the discharge opening 84, which airflow is sufficiently strong to carry dirt and spray water as far as the discharge opening. The spray water (represented in an exemplary manner by wavy, continuous lines emanating from the point of impact 61), which normally diverges along the plane of the conveyor belt 1, is blocked by the air curtain 103 and is diverted vertically upwards into the cleaning head 80. Water is supplied into the annular body of the device 120 for supplying water jets 121. The individual water jets 121 that are then produced cause a rinsing of the inner wall of the cleaning head 80. The water pressure used in this case is 5 bar. Compressed air is supplied into the annular body of the device 140 for supplying compressed air 141. The individual compressed-air jets 141 that are then produced drive the water and the detached dirt particles forward toward the discharge opening 84.

The cleaning by the use of more than one high-pressure jet 60 is more effective than the cleaning by only one jet. The high-pressure jets 60 penetrate from different directions into pores and depressions of the conveyor belt 1, whereby a more thorough cleaning is achieved. The design of the device 100 for supplying compressed air 101 as a hollow annular body having air-supply openings 102 enables the creation of an air curtain 103, which surrounds the spray water. The interior space and the inner walls of the cleaning head 80 are kept clean by the devices 120 and 140 for supplying water jets 121 and compressed air 141, respectively, shown here.

In FIG. 5 a cleaning apparatus 20 according to the invention is depicted in an exemplary manner, which, unlike the previously-shown cleaning apparatuses 20, has three cleaning nozzles 40 (only two are visible, one being covered) for generating laminar high-pressure jets 60, and three inlet openings 82 (only one is visible, two being covered) in the cleaning head 80. One is oriented counter to the moving direction of the conveyor belt 1 and the other two are oriented opposite one another transversely to the conveyor belt 1. The points of impact 61 of the three high-pressure jets 60 are located approximately at the tangential point of the conveyor belt 1 and the roller 21, and they are each located at a distance of 2 mm from one another in a line along the moving direction of the conveyor belt 1. Furthermore, a carrier device 180 having a collection duct system integrated therein is depicted in an exemplary manner. Unlike the previously shown cleaning apparatuses 20, the cleaning apparatus 20 shown here is equipped with a drying unit 160. This drying unit has four air nozzles 161 along the moving direction of the conveyor belt 1, which are each oriented with an offset to the conveyor belt 1 from two different directions or have two different angles of incidence.

During operation of the cleaning apparatus 20, the air nozzles 161 spray conically-shaped air jets 162 onto the conveyor belt 1, and thus dry the portion of conveyor belt 1 that has just been cleaned and that is therefore wet. The angle formed by the air jets and the surface of the conveyor belt 1 is 30°. The jets are generated by compressed air having a pressure of 4 bar. The spray and rinsing water caught and transported away through the cleaning head 82, as well as the detached dirt particles, are flushed out of the collection duct system by means of rinsing jets and scrapers. During the cleaning operation, the cleaning apparatus is moved transversely relative to the conveyor belt 1 along the carrier device 180 using a motor.

The described orientation of the high-pressure jets 60 enables the concentration of the available jet energy onto a small area. The drying unit downstream from the cleaning components ensures a rapid drying of the cleaned conveyor belt 1. By disposing the air nozzles 161 along the run of the belt, a widely-lengthened air curtain is generated in the moving direction.

In FIG. 6 a cleaning apparatus 20 according to the invention is depicted in an exemplary manner, which, unlike the cleaning apparatus of FIG. 5, does not have inlet openings 82 in the cleaning head 80. The main opening 81 therefore has a greater spacing to the conveyor belt 1, in order that the high-pressure jets 60 generated by the cleaning nozzles 40 can strike the conveyor belt 1 in an unimpeded manner. Also, no device 100 for supplying compressed air 101 is provided. Further, the drying unit 162 is equipped with six air nozzles 161, which are disposed in an offset manner relative to one another.

In this embodiment, the spray water and the detached dirt particles are suctioned into the cleaning head 80 solely by a suction—the airflow 83—which also draws air out of the vicinity of the main opening 81 (indicated by a truncated cone bounded by a broken line).

This simplified embodiment is a less expensive variant of the cleaning apparatus 20. The use of six air nozzles 161 instead of four in the drying unit 160 enables an even faster drying of the portion of the conveyor belt 1 that has just been cleaned. However, the new acquisition of a vacuum pump may be necessary.

In FIG. 7 it is shown which angles W1 and W2 can be altered to orient the cleaning nozzles 40. Three high-pressure jet nozzles 40 are shown, which each spray a high-pressure jet 60 onto three different points of impact 61. Both the moving direction 11 of the conveyor belt and the projections 62 of the high-pressure jets onto the conveyor belt 1 are indicated in a dotted manner. W1 in each case is the angle 63 between the moving direction and the projection, W2 in each case is the angle 64 between the conveyor belt surface and the high-pressure jet.

With the invention newly presented here, it is possible for the first time to provide a cleaning apparatus that, through the individual features, but also through the interaction of the features, makes possible significant progress in, for example, drying-screen cleaning. For example, continuous cleaning of the drying screen without an intermediate drying-out phase is possible for the first time. For example, due to the small area on which the cleaning jets strike the conveyor belt, in combination with the cleaning head being positionable close to the conveyor belt—possible through the inlet openings—the cleaning apparatus achieves highly efficient cleaning with, at the same time, effective removal—by the positive pressure—of the dirt and, in addition, the drying unit effects rapid after-drying of the conveyor belt—benefitted by the only small region that is wetted. This cleaning apparatus clearly sets itself apart from the prior art not only by the interaction of these inventive features, but also even by the use of only one of these features or of individual features.

| Reference Numbers | |
|---|---|
| 1 | conveyor belt |
| 2 | paper production system |
| 11 | moving direction |
| 20 | cleaning apparatus |
| 21 | roller |
| 40 | cleaning nozzle |
| 60 | high-pressure jet |
| 61 | point of impact |
| 62 | projection of the high-pressure jet onto the conveyor belt surface |
| 63 | W1 |
| 64 | W2 |
| 71 | heat exchanger |
| 80 | cleaning head |
| 81 | main opening |
| 82 | inlet opening |
| 83 | airflow |
| 84 | discharge opening |
| 100 | device for supplying compressed air |
| 101 | compressed air |
| 102 | air-supply opening |
| 103 | air curtain |
| 120 | device for supplying water jets |
| 121 | water jet |
| 122 | water-jet opening |
| 123 | water connector |
| 140 | device for supplying compressed air |
| 141 | compressed air |
| 142 | air-supply opening |
| 143 | compressed-air connector |
| 160 | drying unit |
| 161 | air nozzle |
| 162 | compressed-air jet |
| 180 | carrier device |

The invention claimed is:

1. A cleaning apparatus comprising:

at least one cleaning nozzle configured to generate and direct a high-pressure liquid jet having a point of impact on a surface to be cleaned;

at least one cleaning head having a main opening that faces towards the surface, a discharge opening and at least one device for supplying compressed air disposed in the region of at least one point of impact of at least one high-pressure liquid jet, on the surface; and wherein the at least one device for supplying compressed air is disposed to create a redirection of spray water from the surface toward the main opening and to create an airflow adapted to force the spray water toward the discharge opening.

2. The cleaning apparatus according to claim 1, wherein the at least one device for supplying compressed air is configured to cause a positive pressure at the main opening.

3. The cleaning apparatus according to claim 1, wherein the surface is a running belt of a drying screen in a paper production installation.

4. The cleaning apparatus according to claim 1, further comprising a drying unit spaced apart from the at least one cleaning head in a moving direction of the surface.

5. The cleaning apparatus according to claim 1, wherein the at least one device for supplying compressed air comprises a hollow annular body at the main opening of the cleaning head.

6. The cleaning apparatus according to claim 1, wherein the at least one device for supplying compressed air comprises a hollow annular body inside the cleaning head.

7. The cleaning apparatus according to claim 1, wherein the at least one device for supplying compressed air comprises a first pipe configured to supply compressed air at the main opening of the cleaning head and a second pipe configured to supply compressed air inside the cleaning head.

8. The cleaning apparatus according to claim 7, wherein the second pipe configured to supply compressed air is configured to generate a vortex inside the cleaning head.

9. The cleaning apparatus according to claim 1 including a spray apparatus inside the cleaning head configured to produce water jets directed away from the main opening of the cleaning head.

10. The cleaning apparatus according to claim 1, wherein the at least one device for supplying compressed air comprises a first pipe configured to supply compressed air at the main opening of the cleaning head and a second pipe configured to supply compressed air inside the cleaning head, the second pipe being configured to generate a vortex inside the cleaning head, the cleaning apparatus further including a spray apparatus inside the cleaning head configured to produce water jets directed away from the main opening of the cleaning head.

11. A method for cleaning a conveyor belt of a drying screen in a paper production system comprising:

spraying at least one high-pressure liquid jet onto a point of impact on the conveyor belt;

directing a source of compressed air towards at least one point of impact of the liquid jet on the conveyor belt to cause liquid ricocheting off the conveyor belt and be steered towards a main opening of a cleaning head; and generating a positive pressure at the area of the at least one point of impact that spreads into the interior space of the cleaning head so as to generate an airflow inside the cleaning head that transports the ricocheting liquid towards the discharge opening of the cleaning head.

12. The method of claim 11 further comprising heating the liquid prior to spraying the at least one high-pressure liquid jet.

13. The method of claim 11 further comprising generating at least one water jet inside the cleaning head that transports dirt and liquid entering into the main opening towards the discharge opening.

14. The method of claim 11 further comprising directing a second source of compressed air inside the cleaning head to transport dirt and liquid entering into the main opening towards the discharge opening.

15. The method of claim 14 wherein the directing the second source of compressed air further comprises generating an air vortex in the interior of the cleaning head.

16. The method of claim 11 further comprising drying the running belt after spraying the at least one high-pressure liquid jet.

17. The method of claim 11 further comprising supplying a source of suction at the discharge opening.

18. The method of claim 11 wherein the source of compressed air is directed to form a ring of compressed air.

19. A method of producing paper in a paper production machine having a drying screen comprising:

spraying at least one high-pressure liquid jet onto a point of impact on a bare conveyor belt of the drying screen;

directing a source of compressed air towards at least one point of impact of the liquid jet on the bare conveyor belt to cause liquid ricocheting off the bare conveyor belt and be steered towards a main opening of a cleaning head; and generating a positive pressure at the area of the at least one point of impact that spreads into the interior space of the cleaning head so as to generate an airflow inside the cleaning head that transports the ricocheting liquid towards the discharge opening of the cleaning head.

20. The method of claim 19 further comprising heating the liquid prior to spraying the at least one high-pressure liquid jet.

21. The method of claim 19 further comprising generating at least one water jet inside the cleaning head that transports dirt and liquid entering into the main opening towards the discharge opening.

22. The method of claim 19 further comprising directing a second source of compressed air inside the cleaning head to transport dirt and liquid entering into the main opening towards the discharge opening.

23. The method of claim 22 wherein the directing the second source of compressed air further comprises generating an air vortex in the interior of the cleaning head.

24. The method of claim 19 further comprising drying the running belt after spraying the at least one high-pressure liquid jet.

25. The method of claim 19 further comprising supplying a source of suction at the discharge opening.

26. The method of claim 19 wherein the source of compressed air is directed to form a ring of compressed air.

* * * * *